US005388179A

United States Patent [19]

Boyd, Jr. et al.

[11] Patent Number: 5,388,179

[45] Date of Patent: Feb. 7, 1995

[54] FLOAT SWITCH FOR PREVENTING DAMAGE TO THE ELECTRIC WATER HEATER ELEMENT

[76] Inventors: Richard Boyd, Jr., 160 Wood Cir., New Bern, N.C. 28562; George Spector, 233 Broadway Rm. 3815, New York, N.Y. 10007

[21] Appl. No.: 770,367

[22] Filed: Oct. 3, 1991

[51] Int. Cl.[6] ..... H05B 1/02; F24H 1/20

[52] U.S. Cl. ..... 392/451; 392/449; 392/485; 392/402; 200/84 R; 200/84 B

[58] Field of Search ..... 392/485, 401, 402, 400, 392/441, 442, 444–452; 200/84 R, 84 A, 84 B

[56] References Cited

U.S. PATENT DOCUMENTS

| | | | |
|---|---|---|---|
| 1,400,526 | 12/1921 | Christian | 200/84 B |
| 1,420,693 | 6/1922 | Cohen | 392/401 |
| 1,682,789 | 9/1928 | Janette | 200/84 R |
| 1,768,446 | 6/1930 | Gron | 200/84 R |
| 2,726,314 | 12/1955 | Prain | 392/451 X |
| 3,422,745 | 1/1969 | Eisendrath | 392/451 X |
| 4,455,477 | 6/1984 | Massey et al. | 392/451 |

FOREIGN PATENT DOCUMENTS

| | | | |
|---|---|---|---|
| 94899 | 7/1960 | Netherlands | 392/401 |

*Primary Examiner*—Mark H. Paschall

[57] ABSTRACT

A device is provided for protecting a heating element in an electric water heater which consists of a sensor for sensing a predetermined amount of water that has entered the electric water heater and an electric circuit with a relay controlled by the sensor, for energizing the heating element when the predetermined amount of water is within the electric water heater and covering the heating element thereby preventing the burn out of the heating element; wherein the sensor has a float with electrical contacts that engage adjustable contacts set at a desired level to energize the heating element at a predetermined water level and includes an expandable seal mounted on the float preventing water from going above the float.

3 Claims, 1 Drawing Sheet

FLOAT SWITCH FOR PREVENTING DAMAGE TO THE ELECTRIC WATER HEATER ELEMENT

BACKGROUND OF THE INVENTION

The instant invention relates generally to immersion-type heaters and more specifically it relates to a device for protecting a heating element in an electric water heater which provides protection to the heating element before the water enters the heater.

There are available various conventional immersion-type heaters which do not provide the novel improvements of the invention herein disclosed.

SUMMARY OF THE INVENTION

The invention is a device that protects the heating element in an electric water heater by energizing the heating element only when sufficient water is in the heater to cover the element preventing burn out. Energization of the heating element at the proper time is accomplished by a float activated switch actuated when the water is at the proper level. The float switch has contacts mounted on a float which engages fixed contacts on the heater when the water is at a predetermined level. Sealing means are provided to prevent access of water above the float. An electric circuit with a relay is provided which is actuated when the floating switch is closed at the proper water level.

An additional object is to provide a device for protecting a heating element in an electric water heater in which the float switch energizes an electric circuit to the heating element at adjustable water levels.

A further object is to provide a device for protecting a heating element in an electric water heater that is simple and easy to use.

A still further object is to provide a device for protecting a heating element in an electric water heater that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
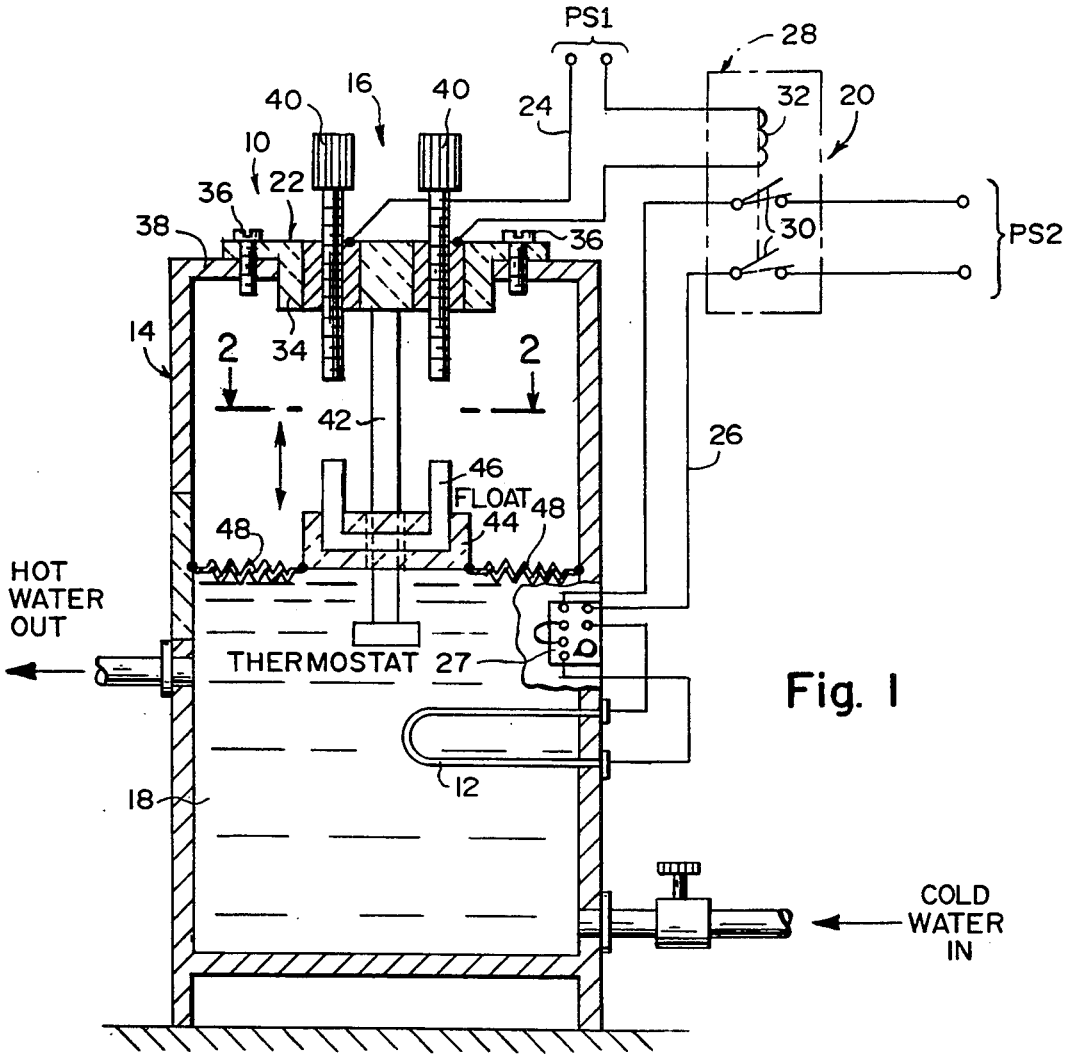
FIG. 1 is a diagrammatic cross sectional view of an electric water heater with the instant invention installed thereto, showing a float which operates a switch responsive to the water level adjustable to variable water levels.
Figure 2:
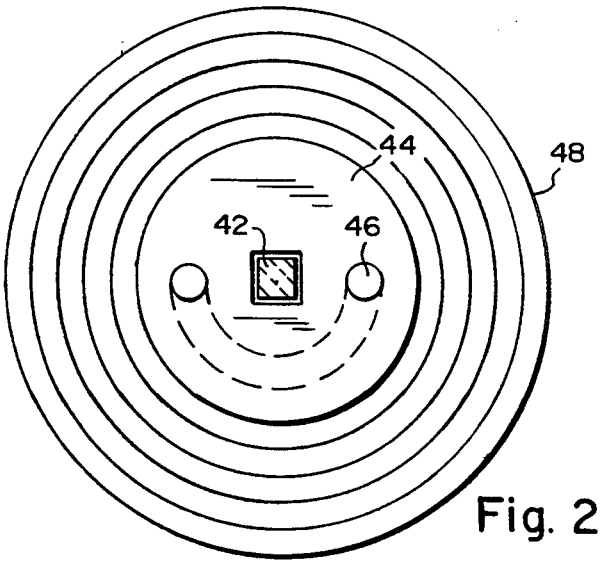
FIG. 2 is a cross sectional view taken along line 2—2 in FIG. 1, showing the float member in greater detail.

Turning now descriptively to the drawings, in which similar reference characters denote similar elements throughout the several views, the Figures illustrate a device 10 for protecting a heating element 12 in an electric water heater 14 which consists of a mechanism 16 for sensing a predetermined amount of water 18 that has entered the electric water heater 14. A mechanism 20 controlled by the sensor mechanism 16, is for energizing the heating element 12 when the predetermined amount of water 18 is within the electric water heater 14 and covering the heating element 12 thereby preventing the burn out of the heating element 12.

The sensing mechanism 16 includes a float switch 22 carried in the upper portion of the electric water heater 14 above the heating element 12. A first electrical circuit 24 connects the float switch 22 to the energizing mechanism 20, so that a first electrical power source PS1 connected to the first electrical circuit 24 will activate the energizing mechanism 20 when the float switch 22 closes by the predetermined amount of water 18 that enters within the electric water heater 14.

The energizing mechanism 20 includes a second electrical circuit 26 connecting the heating element 12 through a thermostat 27 to a second electrical power source PS2 and a relay 28 having a pair of normally opened contacts 30 activated by a solenoid 32. The normally opened contacts 30 are connected to the second electrical circuit 26, while the solenoid 32 is connected to the first electrical circuit 24. When the float switch 22 closes, the solenoid 32 in the relay 28 will close the contacts 30 to energize the heating element 12 through the thermostat 27.

The float switch 22 includes an insulated stationary member 34 removably mounted by bolts 36 to the top 38 of the electric water heater 14. A pair of spaced apart adjustable contacts 40 on the stationary member 34, extend inwardly into the electric water heater. A guide member 42 is centrally mounted to the stationary member 34, extends inwardly into the electric water heater 14. An insulated float member 44 slides on the guide member 42, while being carried on the surface of the water 18. A U-shaped contact 46 is mounted into the float member 44, so as to engage with the adjustable contacts 40 close the first electrical circuit 24. An expandable diaphragm 48 is mounted about the float member 44 and the interior wall surface of the electric water heater 14. The diaphragm 48 will isolate the surface of the water 18 from the float switch 22 above the float member 44, keeping the adjustable contacts 40 and the U-shaped contact 46 water free.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In an electric water heater having a water holding tank, having top, bottom and side walls, a water inlet for supplying cold water to the tank, an outlet for the flow of heated water from the tank, the inlet and outlet being located in the lower portion of the tank, an electric immersion water heating element located in the lower portion of the tank for heating the water therein and a water level responsive control means connected in circuit with the heating element for protecting the heating element, should the water level in the tank fall during use below a level in which the heating element is immersed, the improvement wherein said water level responsive control means comprises:

a) means in said tank for sensing that a predetermined level of water has entered the electric tank to a depth sufficient to cover the immersion heater;

b) means controlled by said sensing means for energizing the heating element only upon sensing by said sensing means of a predetermined level of water in said tank is sufficient to immerse said heating element thereby preventing the burn out of the heating element; wherein said sensing means includes:

c) a float switch in said tank above the heating element; said float switch comprising a lower set of electrical contacts mounted on the upper surface of a float in said tank arranged to float on the surface of the water therein and an upper set of electrical contacts mounted on the tank above said float and aligned for electrical engagement with said lower set of contacts when water in said tank is at said predetermined level; and d) a first electrical circuit connecting said float switch to an energizing means, so that said first electrical circuit activates said energizing means upon engagement of said upper and lower sets of contacts at the predetermined level of water to connect said heating element to a source of power; in further combination with means associated with said float and walls of said tank for preventing access of water above said float; while allowing the float to freely rise and fall with changes in water level in the tank, said upper and lower sets of contacts being located within said tank in water free space above the float.

2. A device as recited in claim 1, wherein said energizing means includes:

a) a second electrical circuit connecting the heating element through a thermostat responsive to water temperature in the tank to an electrical power source; and b) a relay having a pair of normally open contacts activated by a solenoid, the normally open contacts arranged to control energization of said second electrical circuit while the solenoid controls operation of said first electrical circuit, so that in response to engagement of said first and second sets of float switch contacts, the solenoid of said relay will close the relay contacts to energize the heating element through the thermostat.

3. A device as recited in claim 1, wherein said float switch includes:

a) an electrically insulated stationary member removably mounted to the top wall of said tank;

b) said upper set of contacts comprises a pair of spaced apart adjustable contacts on said stationary member, extending inwardly into said tank;

c) a guide member centrally mounted to said stationary member, extending downwardly into said tank;

d) said float comprises an electrically insulated float member apertured to be sealingly slidable on said guide member, while being carried on the surface of the water;

e) said lower set of contacts comprising a U-shaped contact mounted onto said float member so as to engage with said adjustable contacts of said upper set to close said first electrical circuit; and f) an expandable diaphragm sealingly connected to the periphery of said float member and to the interior surface of the side wall of the tank so that said diaphragm will isolate the surface of the water from said float switch above said float member thereby keeping said adjustable contacts and said U-shaped contact water free.

* * * * *